US005752304A

United States Patent [19]

Toeniskoetter

[11] Patent Number: 5,752,304

[45] Date of Patent: May 19, 1998

[54] CLOSURE PANEL HEMMING DIE

[75] Inventor: James B. Toeniskoetter, Troy, Mich.

[73] Assignee: Tesco Engineering, Inc., Auburn Hills, Mich.

[21] Appl. No.: 796,609

[22] Filed: Feb. 7, 1997

Related U.S. Application Data

[62] Division of Ser. No. 515,457, Aug. 15, 1995, Pat. No. 5,611,133.

[51] Int. Cl.[6] ..... B23P 11/00

[52] U.S. Cl. ..... 29/243.58

[58] Field of Search ..... 29/243.5, 243.58, 29/897.2, 509, 513, 521; 228/136, 137, 173.1, 173.2, 173.6

[56] References Cited

U.S. PATENT DOCUMENTS

| | | | |
|---|---|---|---|
| 3,909,918 | 10/1975 | Takizawa et al. | 29/513 |
| 4,441,241 | 4/1984 | Hoeffken | 29/521 |
| 4,738,560 | 4/1988 | Brussow | 228/137 |
| 4,827,595 | 5/1989 | Dacey, Jr. | 29/243.58 |
| 5,107,579 | 4/1992 | Kostermeier | 29/513 |
| 5,150,508 | 9/1992 | St. Denis | 29/243.5 |
| 5,195,580 | 3/1993 | Hoeffken | 29/521 |
| 5,237,734 | 8/1993 | Polon | 29/243.58 |

*Primary Examiner*—David P. Bryant
*Attorney, Agent, or Firm*—Fildes & Outland,P.C.

[57] ABSTRACT

A hemming machine for forming a unitary closure structure from first and second metal panels includes a lower and upper die mounted and moveable relative to each other for edge hemming a portion of the periphery of panels to form a unitary structure. The machine includes a non-hemming jointing device mounted adjacent to one of the upper and lower dies and operable for jointing a portion of the non-hemmed periphery of the panels as the panels are held between the dies.

12 Claims, 4 Drawing Sheets

CLOSURE PANEL HEMMING DIE

CROSS-REFERENCE TO RELATED APPLICATION

This is a divisional of application Ser. No. 08/515,457 filed on Aug. 15, 1995, now U.S. Pat. No. 5,611,133.

FIELD OF THE INVENTION

This invention relates to hemming machines for joining two preformed metal panels and more particularly to an improved hemming machine for constructing vehicle closure panels.

BACKGROUND OF THE INVENTION

It is known in the automotive industry to join two metal preformed panels into a unitary hollow structural unit. Typical units of this type include vehicle doors, hoods, and trunk lids. Collectively, these units are referred to as closure panels.

A conventional process of joining the two panels together is referred to as hemming and results in a flange of the outer panel being folded over and gripping the edge of the inner panel. The process is well known. A conventional method and apparatus for joining two metal preformed panels is disclosed in U.S. Pat. No. 5,150,508 and its disclosure is incorporated herein by reference.

However, a problem exists in applying the conventional hemming process to complex shapes used on some hoods and trunk lids. Usually the hemming process is used to hem a majority of the periphery of a pair of corresponding preformed panels. A portion of the periphery may be difficult to hem due to the requirement of complex die shapes or the requirement of a plurality of dies so that some of the periphery may be non-hemmable.

In such cases the pair of panels is removed from the hemming machine that imparts the hemmed edge and in a separate process, at a separate station, the non-hemmed portion is spot welded or extruding clinched to join the non-hemmed portion of the panels together.

Spot welding of the non-hemmed portion of the otherwise hemmed periphery of a closure panel works well with steel panels generally. However, the use of aluminum in many of today's closure panels creates additional problems as aluminum does not easily spot weld.

SUMMARY OF THE INVENTION

The present invention provides a hemming machine and method in combination with a non-hemming jointing apparatus that allows complex shaped preformed metal panels to be joined to form vehicle closure panels through the process of hemming and non-hemming jointing.

The present invention also provides a hemming machine and method that allow the jointing to be performed at a single station.

In addition, the present invention provides a hemming machine and method that allows for the jointing of aluminum panels without welding.

More specifically, in accordance with an aspect of the invention, there is provided a hemming machine for hemming a unitary structure, having a periphery defined by a hemmed joint portion and a non-hemmed joint portion, from two preformed metal panels.

Accordingly, the machine includes a lower die for receiving first and second panels in a superimposed relation. An upper die moveable relative to the lower die is operable for edge hemming a portion of the periphery of the panels. A non-hemming jointing device mounted adjacent to one of the lower and upper dies is operable for jointing a portion of the non-hemmed periphery of the panels.

A method for jointing two preformed metal panels in such a hemming machine having lower and upper dies and a non-hemming jointing device into a hollow and unitary structure includes the steps of:

hemming a portion of the periphery of the panels to form a unitary structure through the operation of the dies; and non-hemmingly jointing a flange on the non-hemmed portion of the periphery of the panels as the two panels are engaged between the dies.

These and other features and advantages of the invention will be more fully understood from the following detailed description of the invention taken together with the accompanying drawings.

DETAILED DESCRIPTION OF THE INVENTION

Figure 2:
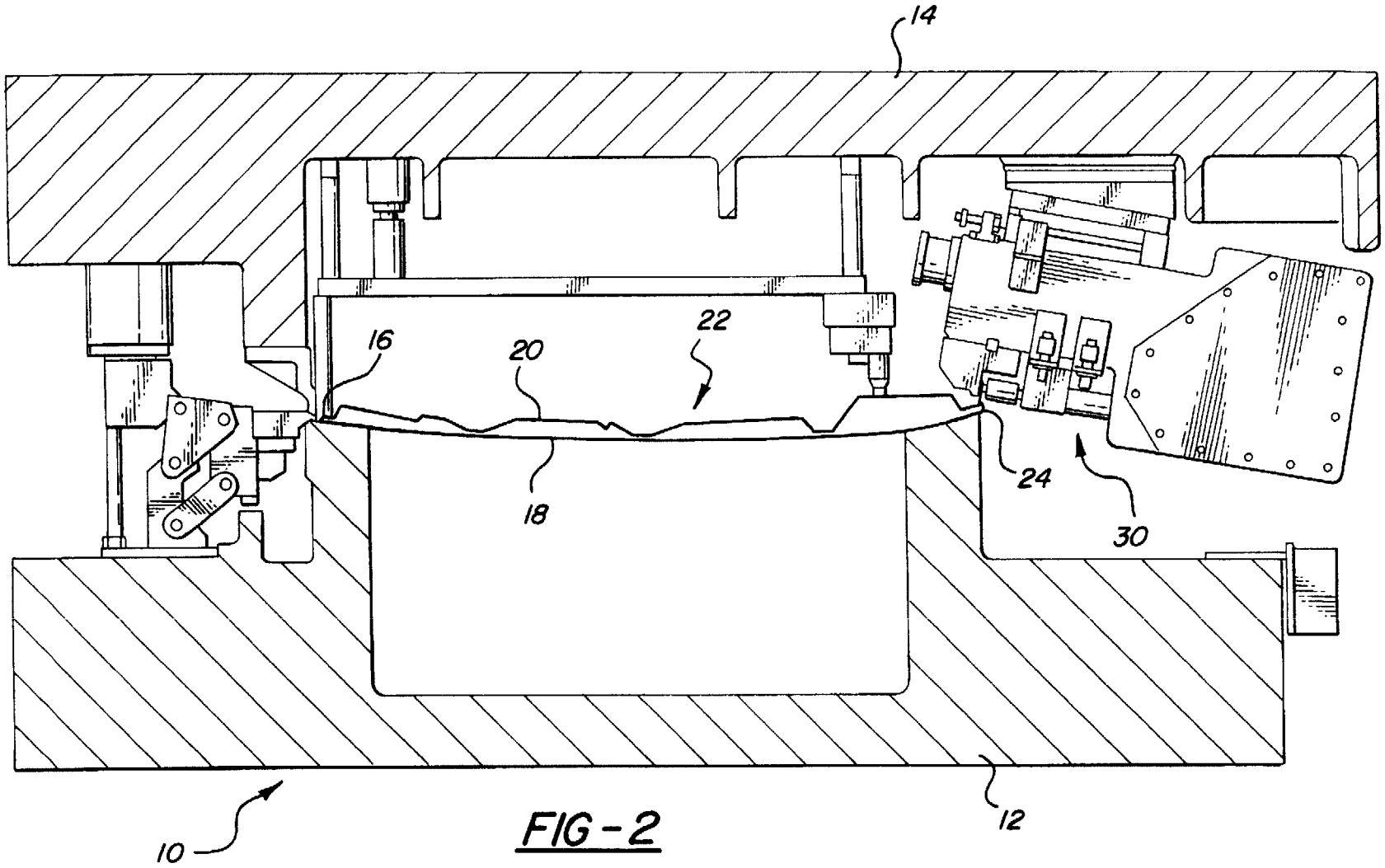
FIG. 2 is an elevational sectional view of a portion of the hemming machine of FIG. 1 illustrating an embodiment of lower and upper dies wherein first and second metal panels are held between the dies in a closed hemming position of the dies and the non-hemming jointing device is mounted on the upper die for non-hemmingly jointing a flange on the panels.

Referring now to the drawings in detail, numeral 10 generally indicates a hemming machine including lower and upper dies 12, 14. Dies 12, 14 are mounted and moveable relative to each other by conventional actuating means for edge hemming a portion of the periphery 16 of metal panels 18, 20 to form a unitary closure structure 22 as illustrated in FIG. 2.

A non-hemming jointing device 30 is mounted relative to one of the lower and upper dies 12, 14. The non-hemming jointing device 30 is operable for jointing a portion of the non-hemmed portion 24, typically a flanged portion, of the periphery of the metal panels 18, 20 as the panels are held between the dies 12, 14.

A suitable non-hemming jointing device 30 is a spot welding device, an example of which is a spot welding gun of the type by Savair Limited. Other types of spot welding devices are well known. Spot welding of the metal panels 18, 20 works well with steel panels and allows the non-hemmed portion of the periphery of the panels to be joined within the hemming machine 10, thereby eliminating the need for a subsequent processing station.

Another suitable non-hemming jointing device 30 is an extruding clinch jointing device such as that referred to as a Tog-L-Loc® device by BTM Corporation of Marysville, Mich.

Figure 1:
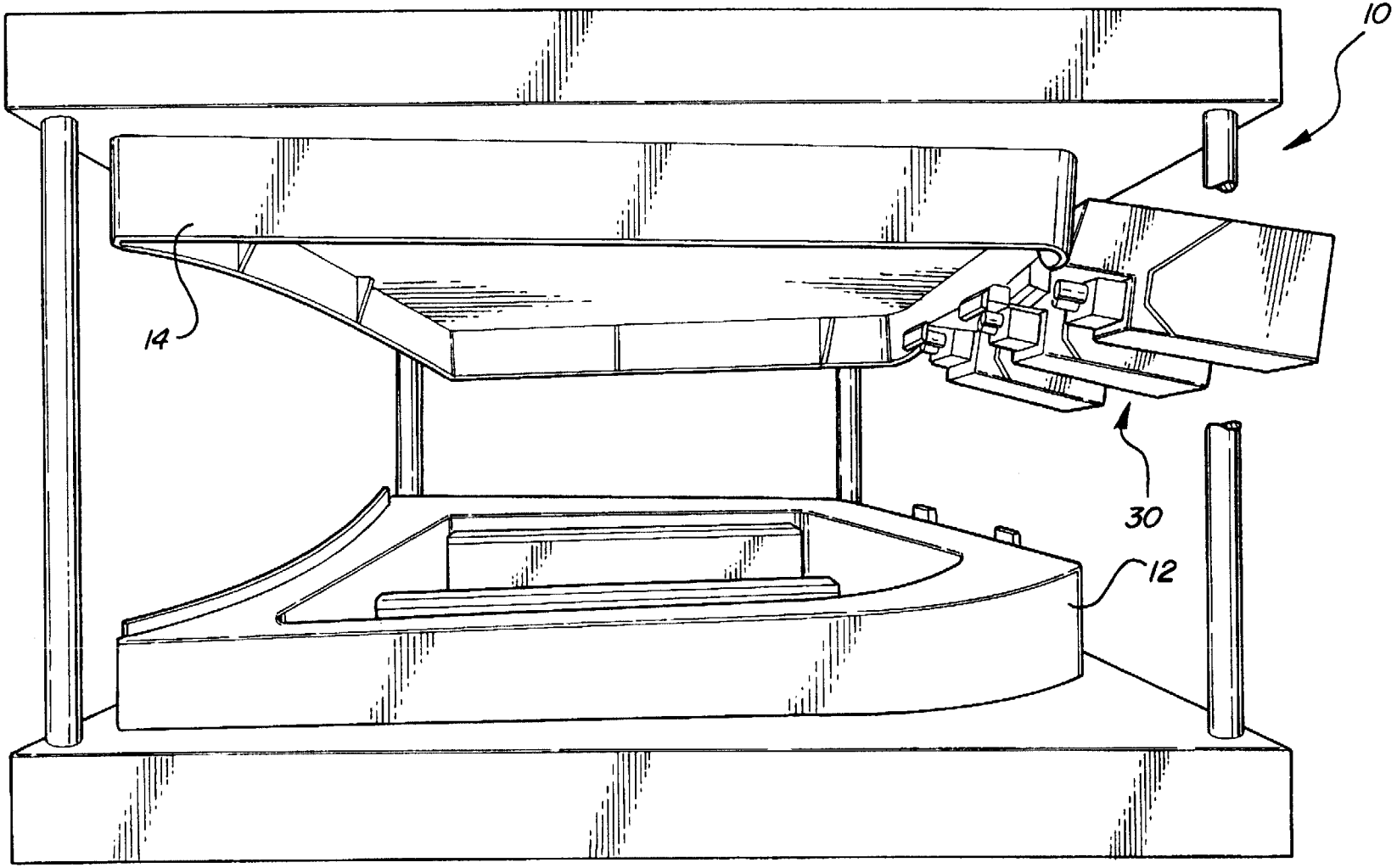
FIG. 1 is a perspective elevational view of a hemming machine constructed in accordance with the present invention illustrating lower and upper dies, and a non-hemming jointing device.

With reference to FIGS. 1 and 2, the non-hemming jointing device 30 is mounted to the upper die 14. Mounting the non-hemming jointing device 30 to the upper die keeps the non-hemming jointing device out of the way of panels 18, 20 as they are fed into and out of hemming machine 10.

Figure 3:
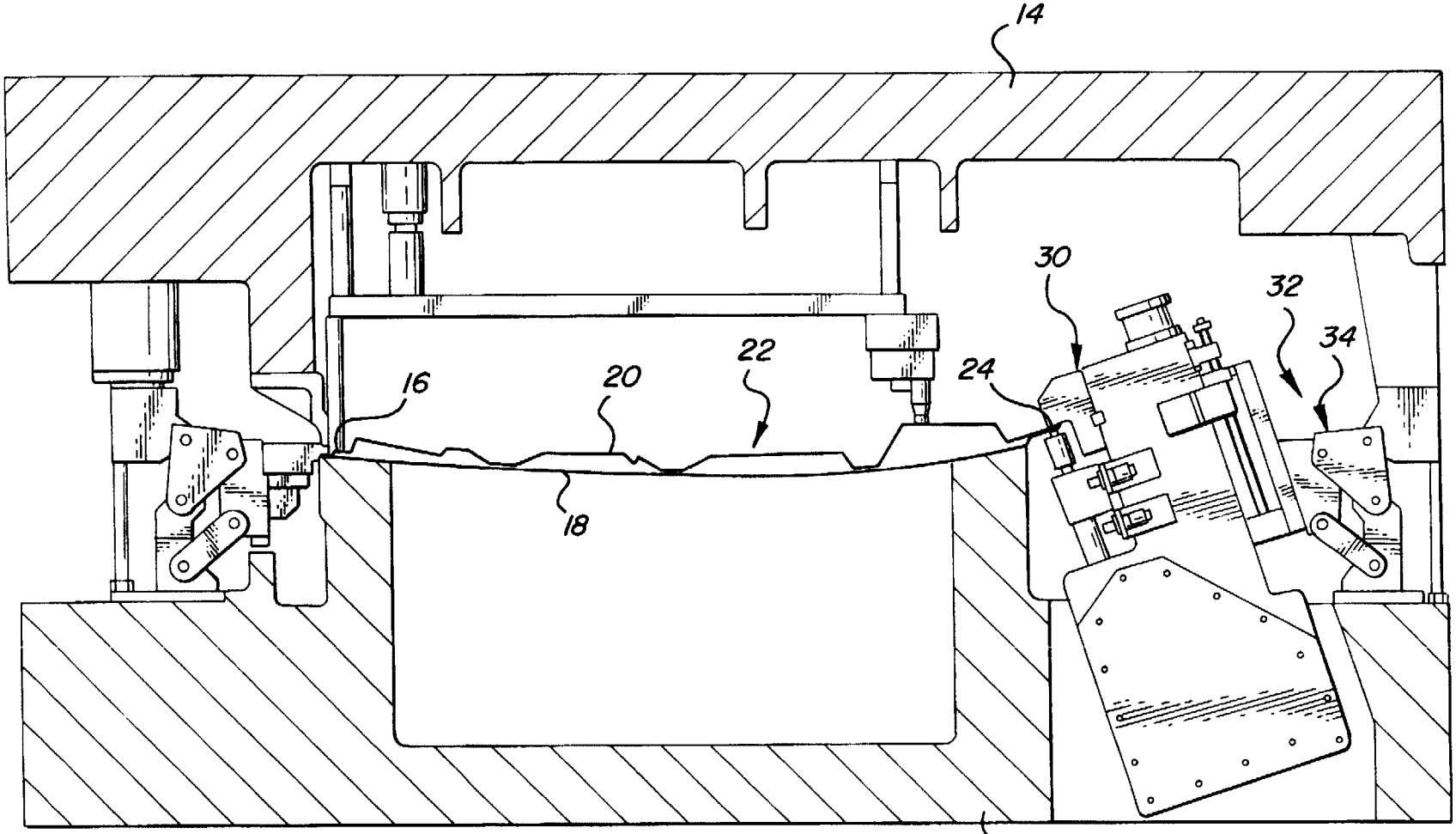
FIG. 3 is an elevational sectional view of a portion of a hemming machine constructed in accordance with the present invention illustrating another embodiment of lower and upper dies wherein a non-hemming jointing device is supported relative to the lower die for cam actuated movement into and out of a jointing position.

Alternatively, non-hemming jointing device 30 can be mounted on a support 32 that allows the non-hemming jointing device 30 to be moved relative to one of the lower or upper dies 12, 14. As illustrated in FIG. 3, the support 32 includes a cam assembly 34 for actuating movement of the non-hemming jointing device into and out of position for non-hemming jointing of the panels 18, 20 between the lower and upper dies 12, 14. As illustrated in FIG. 3, the non-hemming jointing device 30 is mounted for movement relative to the lower die 12 and is shown in position for jointing a non-hemmed flange 24 on panels 18, 20.

Figure 4:
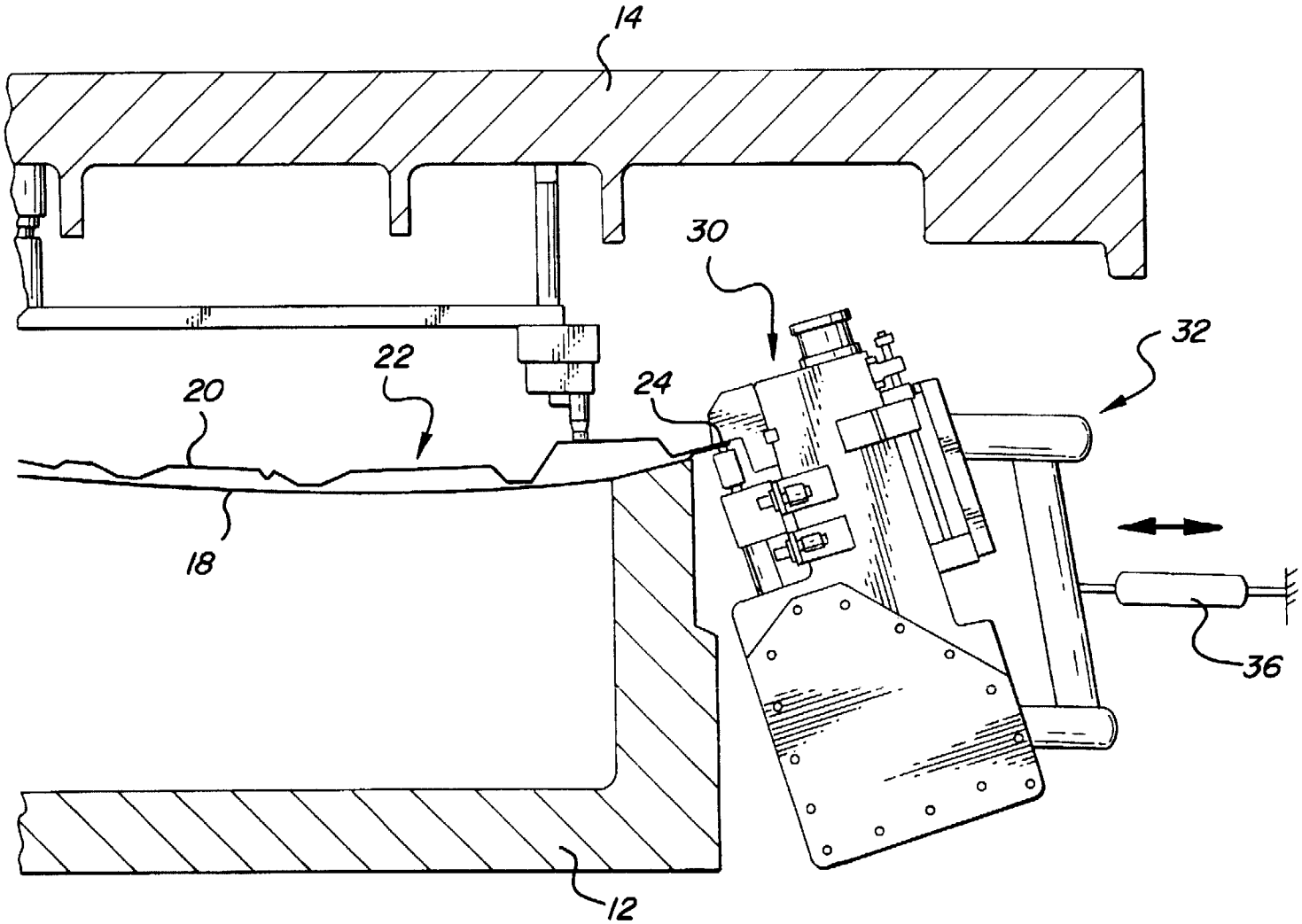
FIG. 4 is an elevational sectional view of a portion of a hemming machine constructed in accordance with yet another embodiment of the invention illustrating upper and lower dies and a non-hemming jointing device movably supported relative to the upper and lower dies for movement into and out of the hemming machine.

With reference to FIG. 4, support 32 mounts the non-hemming jointing device 30 for traveling movement into and out of the hemming machine 10. A fluid operated cylinder 36, of the air or hydraulic type, is operable for moving the non-hemming jointing device into and out of the hemming machine 10. Alternatively, a rack and pinion assembly, or other means, could be used to move the non-hemming jointing device 30.

The hemming machine 10 is operable to form a vehicle closure panel 22 from first, outer, and second, inner panels 18, 20, disposed between lower and upper dies 12, 14. The inner panel 20 is nested together with the outer panel 18 into the lower die 12. Panels 18, 20 are located relative to the lower die 12. As dies 12, 14 are moved toward each other, the panels 18, 20 are clamped in the lower die 12. The corners of the outer panel 18 are then prehemmed. Thereafter, a portion of the periphery of the outer panel 18 is prehemmed.

With continued movement of dies 12, 14, the inner and outer panels 18, 20 are final hemmed. The non-hemmed portion 24 of the periphery of the panels 18, 20, typically a flanged portion, is non-hemmingly jointed as the panels are clamped between the dies 12, 14. The non-hemmingly jointing can be performed by spot welding, extruding clinch jointing or combination of the two methods.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A hemming machine for forming a unitary closure structure from first and second metal panels, said machine including lower and upper dies mounted and moveable relative to each other for edge hemming a portion of a periphery of said panels to form a unitary structure, said machine characterized by:

a non-hemming jointing device mounted adjacent to one of said lower and upper dies and operable for jointing a non-hemmed portion of the periphery of said panels as said panels are held between said dies.

2. The hemming machine of claim 1 characterized in that the non-hemming jointing device is mounted on one of said dies.

3. The hemming machine of claim 1 characterized by a support for mounting said non-hemming jointing device for movement relative to said one of said lower and upper dies.

4. The hemming machine of claim 3 characterized in that said support includes an actuator for moving said non-hemming jointing device.

5. The hemming machine of claim 4 characterized in that said actuator is a cam assembly.

6. The hemming machine of claim 4 characterized in that said actuator is fluid actuated.

7. The hemming machine of claim 1 characterized in that said non-hemming jointing device is a spot welding device.

8. The hemming machine of claim 7 characterized in that said spot welding device is mounted on said upper die.

9. The hemming machine of claim 7 characterized in that said spot welding device is mounted on said lower die.

10. The hemming machine of claim 1 characterized in that said non-hemming jointing device is an extruding clinch jointing device.

11. The hemming machine of claim 10 characterized in that said extruding clinch jointing device is mounted on said upper die.

12. The hemming machine of claim 10 characterized in that said extruding clinch jointing device is mounted on said lower die.

* * * * *